United States Patent [19]

Gregory et al.

[11] Patent Number: 4,911,580

[45] Date of Patent: Mar. 27, 1990

[54] APPARATUS AND METHOD FOR RAISING AND SUPPORTING A BUILDING

[75] Inventors: Steven D. Gregory; Darin Willis, both of Dallas, Tex.

[73] Assignee: Steven D. Gregory, Dallas, Tex.

[21] Appl. No.: 389,501

[22] Filed: Aug. 4, 1989

[51] Int. Cl.[4] ..... E02D 5/00

[52] U.S. Cl. ..... 405/230; 405/229; 254/29 R

[58] Field of Search ..... 405/230, 229, 196, 198, 405/228; 254/29 R

[56] References Cited

U.S. PATENT DOCUMENTS

| | | | |
|---|---|---|---|
| 1,827,921 | 10/1931 | White | 405/230 |
| 2,982,103 | 5/1961 | Revesz | 405/230 |
| 3,796,055 | 3/1974 | Mahony | 405/230 |
| 3,852,970 | 12/1974 | Cassidy | 405/230 |
| 4,070,867 | 1/1978 | Cassidy | 405/230 X |
| 4,765,777 | 8/1988 | Gregory | 405/230 |

FOREIGN PATENT DOCUMENTS

| | | | |
|---|---|---|---|
| 1418164 | 12/1975 | United Kingdom | 405/230 |

*Primary Examiner*—Dennis L. Taylor
*Attorney, Agent, or Firm*—Warren B. Kice

[57] ABSTRACT

An apparatus and method for raising and supporting the foundation or slab of a building, in which a lifting arm assembly engages the lower surface of the foundation or slab and is secured thereto. A piling assembly is disposed in a support sleeve adjacent the lifting assembly and is engaged by a clamping assembly. A hydraulic ram is connected between the clamping assembly and the lifting arm assembly in the expanded position of the ram so that when the ram is retracted, the piling is driven into the ground until it encounters a predetermined resistance. A drive plate is placed in operative relation to the piling assembly and over a pair of rods attached to the lifting arm assembly. The ram is further actuated after the predetermined resistance is encountered to raise the lifting arm assembly, the rods, and the foundation or slab a predetermined distance relative to the drive plate, after which the rods are secured to the piling assembly.

15 Claims, 3 Drawing Sheets

APPARATUS AND METHOD FOR RAISING AND SUPPORTING A BUILDING

BACKGROUND OF THE INVENTION

This invention relates to an apparatus and method for raising and supporting a building, and more particularly to such an apparatus and method in which pilings are used to support the foundation or concrete slab of a building.

Houses and other buildings are often erected on foundations or concrete slabs which are not in direct contact with load supporting underground strata, such as bedrock, or the like. If not initially constructed properly, or if soil conditions change, the foundation footing may settle, causing the foundation or slab to sag and/or crack. Unless the building is supported, or shored, continued settling may result in major structural damage or collapse of the building.

There have been several suggestions in the prior art for raising and supporting the foundation or slab of a building of this type. For example, according to one technique the foundation or slab is lifted, or jacked up, and pilings are inserted underneath to support same. However, the pilings are often not directly supported on the bedrock, resulting in continued settling after the pilings are in place. Also, these techniques often require extensive evacuation of the basement flooring for placing the pilings under the foundation walls, which is expensive. Further, in many instances, the pilings are visible above the basement floor.

In still other prior art techniques utilizing pilings, a single hydraulically actuated system is used for each piling requiring the use of a relatively high hydraulic pressure system which is expensive add cumbersome to use. Also, if the pilings are lifted individually, the structure of the foundation or slab becomes uneven which causes additional potential problems.

Also, according to many prior art techniques the pilings have to be mechanically attached to the raised foundation or lifting bracket after the foundation has been lifted, which requires time and skilled labor.

Still additional problems are encountered when sleeve type brackets are used to apply a concentric, asymmetrical load to a piling, since in these systems the piling tends to buckle. When symetrical loads are applied they have to be bolted to the foundation which requires expensive epoxy bolts, which tend to rip out from weak concrete. Also, these systems are time-consuming to install and must be fastened to the face of the foundation and thus often have to be exposed above grade when used with relative shallow foundations.

SUMMARY OF THE INVENTION

It is an object of the present invention to provide an apparatus and method for supporting and raising a foundation or slab in which pilings are inserted between the lower surface of the foundation or slab and are supported directly on bedrock.

It is still further object of the present invention to provide an apparatus and method of the above type in which the pilings are relatively strong and invisible after the method is completed.

It is a still further object of the present invention to provide an apparatus and method of the above type, which requires minimum evacuation of the ground surrounding the foundation or slab.

It is a still further object of the present invention to provide an apparatus and method of the above type in which a pair of hydraulic systems operate in tandem with each piling assembly.

It is a still further object of the present invention to providing an apparatus and method of the above type in which the pilings are easily attached relative to the raised foundation with a minimum of time and effort.

It is a still further object of the present invention to provide an apparatus and method of the above type in which a symetrical load is applied via a moment arm directly to the foundation in a manner to stabilize the system and provide for a significant mechanical advantage permitting a relatively efficient and precise operation.

It is a still further object of the present invention to provide an apparatus of the above type which eliminates the need for bolting the apparatus to the foundation and the disadvantages associated therewith.

Toward the fulfillment of these and other objects, the apparatus of the present invention includes a lifting assembly engaging the lower surface of the foundation or slab and secured to the foundation or slab. A drive unit engages the upper portion of the pilings, and the respective ends of a hydraulic ram unit are connected between the lifting assembly and the drive unit. The ram unit is then retracted to drive the pilings into the ground. After resistance is encountered a drive plate is driven down relative to two threaded bolts to raise the foundation after which nuts are advanced on the bolts to secure the assembly in the raised position.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
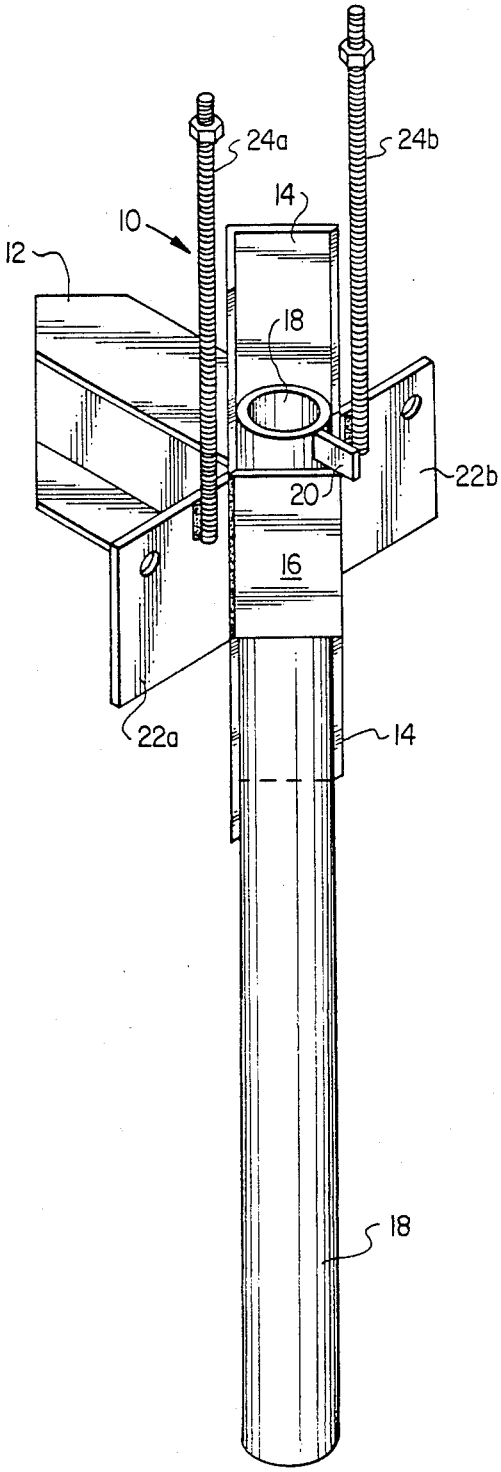
FIGS. 1–3 are perspective views depicting the apparatus of the present invention in various stages of operation.

Referring specifically to FIG. 1 of the drawing, the reference numeral 10 refers, in general, to the lifting assembly of the present invention which includes a lifting arm 12, in the form of an I-beam, which extends under the foundation or slab to be lifted. A relatively long channel iron 14 is welded to one end of the lifting arm 12 and extends perpendicular thereto. A relatively short channel iron 16 is welded to the channel iron 14 along their respective corresponding longitudinal edges to define an opening for receiving a support sleeve 18. A lip 20 is welded to the upper end portion of the sleeve 18 which engages the channel iron 16 to maintain the sleeve in the position shown with the upper end portion extending slightly above the channel irons 14 and 16, for reasons to be explained.

A pair of mounting plates **22*a* and 22*b* are welded to the respective corresponding welded edges of the channel irons 14 and 16 and each has an opening extending there through. A pair of threaded rods 24*a* and 24*b*** are welded to the plates 22*a* and 22*b*, respectively and extend upwardly therefrom for reasons to be described.

Figure 2:
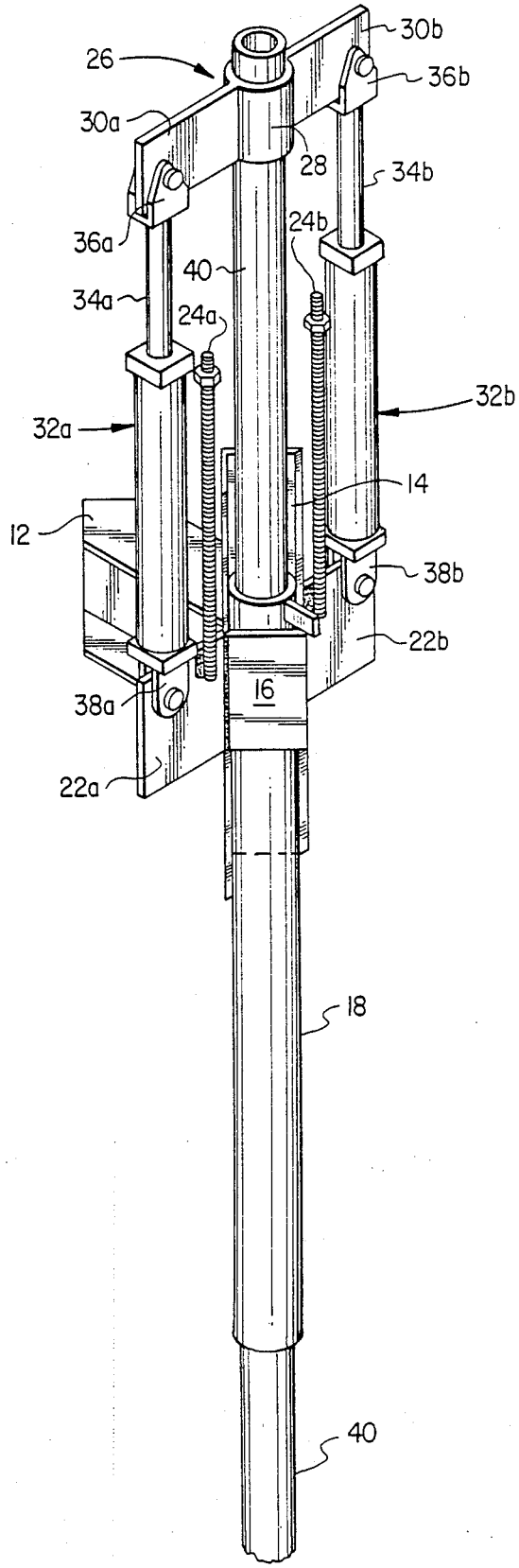

FIG. 2 depicts the apparatus of FIG. 1 with a hydraulic drive assembly mounted thereon. The reference numeral 26 refers, in general, to a driving, or clamping, assembly, which includes a gripping sleeve 28. Although not clear from the drawings, it is understood that the sleeve 28 is in the form of a conventional "slip bowl" for grabbing or clamping over a pipe and, as such, includes three inner arcuate inserts (not shown) which are tapered in a vertical direction so that they will grab, or clamp, a pipe segment of a predetermined diameter during downward movement, and slide over the pipe segment during upward movement, in a conventional manner. A pair of mounting plates 30*a* and 30*b* are connected to, and extend from, diametrically opposite portions of the sleeve 28 and each has an opening extending there through. This clamping assembly 26 is disclosed in more detail in applicant's U.S. Pat. No. 4,765,777, the disclosure of which is hereby incorporated by reference.

A pair of hydraulic ram units 32*a* and 32*b* are adapted for installation between the respective plates 22*a* and 30*a* and the plates 22*b* and 30*b*. The ram units 32*a* and 32*b* include a pair of arms 34*a* and 34*b*, respectively, which are connected to pistons (not shown) which reciprocate in the ram units in response to actuation of the units, in a conventional manner. This reciprocal movement of the pistons causes corresponding movement of the arms 34*a* and 34*b* between the extended position shown in FIG. 2 and a retracted position.

The ram units 32*a* and 32*b* include a pair of clevises 36*a* and 36*b* respectively, which are connected to the respective ends of the arms 34*a* and 34*b*. The clevises 36*a* and 36*b* extend over the plates 30*a* and 30*b* respectively and are connected to the latter plates by a pair of bolts. In a similar manner, a pair of clevises 38*a* and 38*b* are connected to the lower ends of the ram units 32*a* and 32*b* respectively, extend over the plates 22*a* and 22*b*, and are connected to the latter plates by a pair of bolts.

The sleeve 28 of the clamping assembly 26 extends around a piling, or pipe assembly, shown in general by the reference numeral 40 which comprises a plurality of pipe segments connected together in a conventional manner. Due to the tapered configuration of the above-described arcuate inserts, the clamping assembly 26 can be manually lifted upwardly on the piling assembly 40 without encountering substantial resistance. When the hydraulic ram units 32*a* and 32*b* are then retracted, the clamping assembly 26 moves downwardly over the piling assembly 40 and the inserts grab, or clamp, the outer surface of the pipe assembly and force it downwardly, as will be described in further detail later.

To install the lifting assembly 10, the area around the foundation to be lifted is initially excavated and the lifting assembly is placed in the excavated area with the lifting arm 12 extending underneath the house (not shown) and against the lower surface of the foundation. The sleeve 18 is inserted through the opening defined by the channel irons 14 and 16 and driven into the ground until the lip 20 engages the upper end of the channel iron 16. The sleeve can be driven manually or by use of the hydraulic ram units 32*a* and 32*b* in the manner described herein.

A section of the piling assembly 40 is then placed in the sleeve 18 and the clamping assembly 26 is placed over the upper portion of the piling assembly. The hydraulic ram units 32*a* and 32*b* in their extended positions shown in FIG. 2, are then installed between the respective plates 22*a* and 30*a* and the plates 22*b* and 30*b*, respectively.

The ram units 32*a* and 32*b* are then actuated simultaneously to cause a retracting motion of their corresponding pistons, and therefore the arms 34*a* and 34*b* to force the clamping assembly 26 downwardly. As a result, the sleeve 28 grabs the piling assembly 40 and forces it downwardly into the ground for a predetermined distance. The ram units 32*a* and 32*b* are then simultaneously actuated back to their expanded condition, moving the clamping assembly 26 upwardly to an upper portion of the piling assembly 40, and the sequence is repeated. During this sequential driving of the piling assembly 40 into the ground, additional pipe segments may be added to the assembly 40 as needed.

It is understood that a shim (not shown) can be inserted between the side wall of the foundation and the upper nd portion of the channel iron 14 as needed to stabilize and align the system during the above operation.

The above procedure is repeated until the lower end portion of the piling assembly 40 encounters resistance in the ground, which is usually in the form of bedrock or the like, in which case the aforementioned driving movement is terminated.

Figure 3:
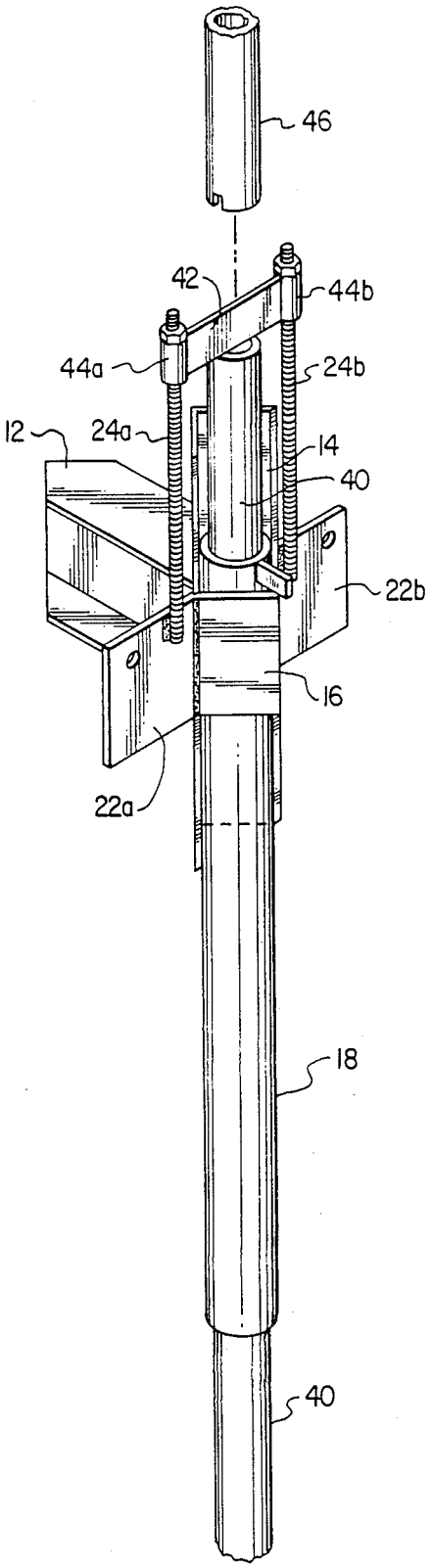
Figure 4:
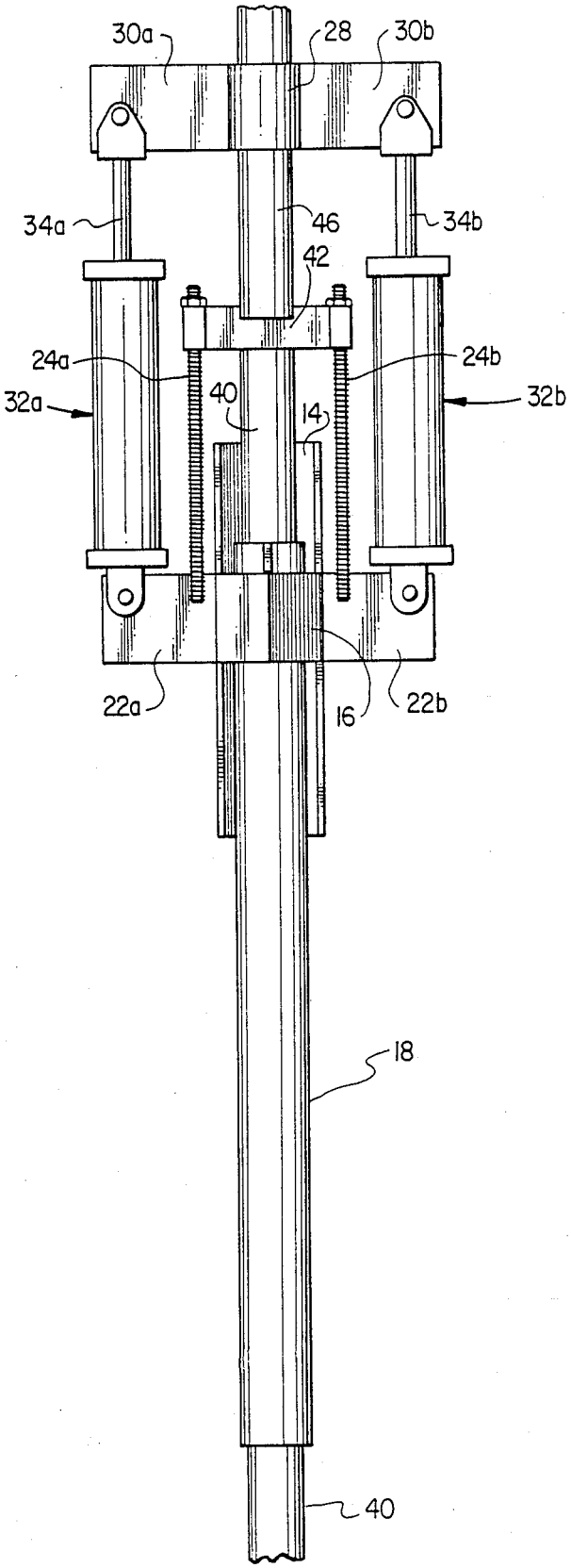
FIGS. 4 and 5 are front elevational views of the apparatus of FIGS. 1–3 showing additional stages of operation.

After resistance is encountered the procedure depicted in FIGS. 3 and 4 is initiated. More particularly, the upper segment of the piling assembly 40 is cut off so that a few inches extend above the upper end of the sleeve 18. A drive plate 42 having two sleeves 44*a* and 44*b* at its ends is positioned over the upper piling segment with its lower edge engaging the segment and with the sleeves 44*a* and 44*b* extending over the rods 24*a* and 24*b* respectively. A drive pipe segment 46 is then placed over the plate 42, with notches in the former extending over the upper edge of the latter.

As shown in FIG. 4 the clamping assembly 26 and the hydraulic ram units 32*a* and 32*b* are installed in the manner described in connection with FIG. 2 with the sleeve 28 extending over the pipe segment 46. The arms 34*a* and 34*b* are expanded to the extent needed for the sleeve 28 to grasp the upper end portion of the pipe segment 46.

The ram units 32*a* are then retracted to exert a vertical force against the piling assembly 40 and therefore the plate 42 and the pipe segment 46. Since the piling assembly 40 can no longer be driven downwardly, the foundation will be lifted the desired amount causing the lifting arm 12, the channel iron 14 and 16, the plates 22*a* and 22*b*, and the rods 24*a* and 24*b* to move upwardly relative to the piling assembly 40, the plate 42, and the pipe segment 46 to the position shown in FIG. 5. Thus the plate 42 is spaced from its original position on the rods 24*a* and 24*b* a distance corresponding to the distance of the lift of the foundation.

Figure 5:
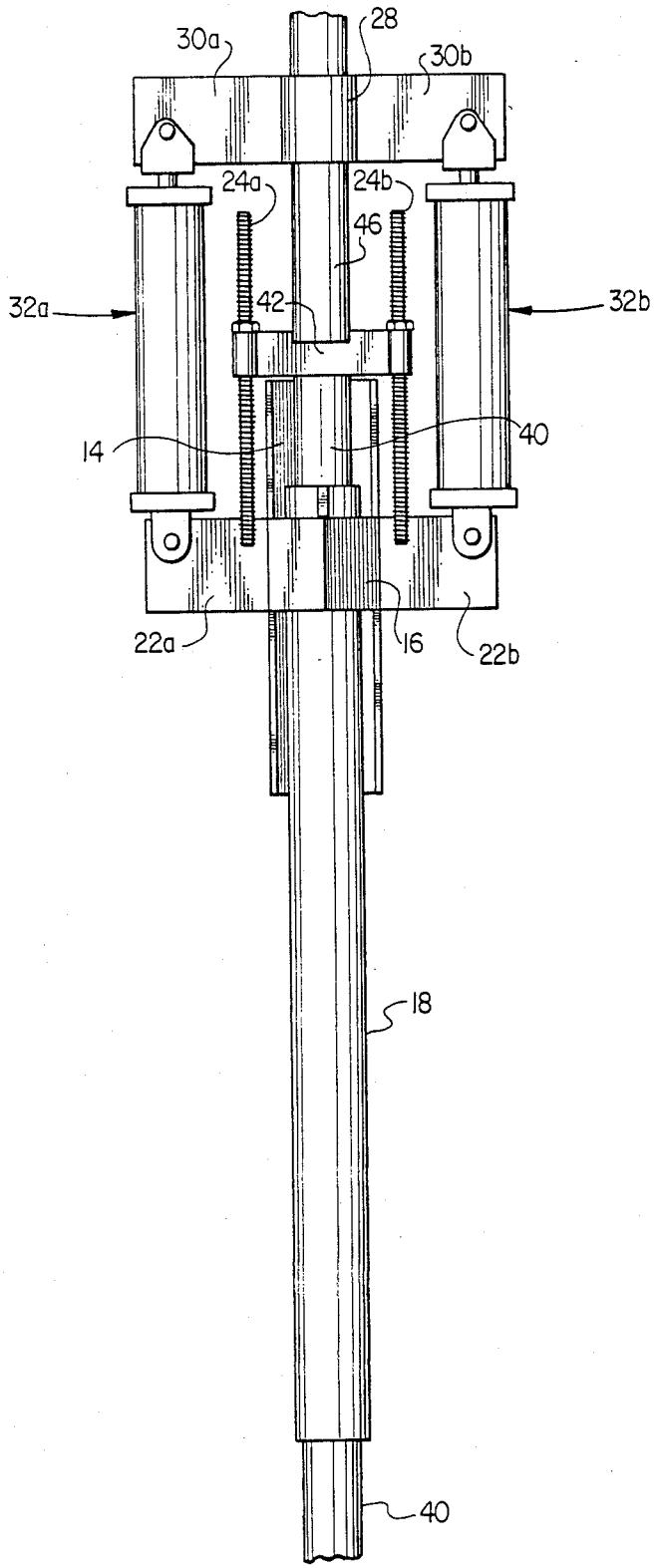

A pair of nuts 48*a* and 48*b* are then advanced downwardly over the rods 24*a* and 24*b* respectively until they engage the plate 42 to secure the assembly in the position of FIG. 5. The hydraulic ram units 32*a* and 32*b* along with the clamping assembly 26 and the pipe segment 46 are then removed, and the area around the assembly is filed with dirt.

Although only one lifting assembly 10 is shown in the drawing it is understood that, in actual practice, several will be used at once at different locations along the foundation depending on the extent of the damage, in which case, after all of the piling assemblies 40 have been driven into the ground until they encounter resistance, all of the ram units 32*a* and 32*b* associated with the piling assemblies are simultaneously actuated again in the manner described in connection with FIGS. 4 and 5 to raise the foundation, and therefore the house, a predetermined distance.

It is apparent from the foregoing that several advantages result from the assembly and method of the present invention. For example, the pilings formed according to the present invention are supported directly on load bearing strata, which adds stability to the supporting system. Also, the pilings are relatively strong and invisible after the method is completed even though only minimum excavation of the ground surrounding the foundation is required.

Further, the assembly and method of the present invention eliminates the need for high pressure ram devices, yet permits all of the piling assemblies associated with the particular foundation to be raised at once. Also, a symetrical load is applied to the pipe assembly through a moment arm that provides a significant mechanical advantage. Still further the lifting assembly can be quickly and easily attached to the foundation after the left, by simply threading two nuts over two threaded rods.

It is understood that, although the above example was described in connection with the foundation of a building, the system of the present invention can also be used in an identical manner to raise a concrete slab extending underneath the entire area of a building or a house. In the case of a concrete slab, the lifting assembly 10 would be engaged adjacent an outer edge of the slab. In the case of damage to, or sinking of, an internal portion of the slab a hole can be formed through the damaged portion of the slab, the lifting arm 12 can be inserted through the hole, and the lifting assembly 10 can be raised and the portion of the slab supported in the manner discussed above.

It is understood that several modifications of the apparatus and method of the present invention can be made within the scope of the invention. For example, the clamping assembly 26 can be replaced with a block, or driving member that engages the upper end of the pipe assembly 40 and, when forced downwardly by the ram units 32*a* and 32*b*, drives the assembly into the ground. Also, an external drive system can be provided to drive the sleeve 18 and then the piling assembly 40 into the ground until a predetermined resistance is encountered, after which the ram units 32*a* and 32*b* can be installed and activated to raise the foundation or slab in the manner described above.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention therein.

What is claimed is:

1. An apparatus for raising and supporting the foundation or slab of a building, said apparatus comprising a lifting arm assembly for engaging the lower surface of said foundation or slab, at least one rod extending upwardly from said lifting arm, piling means having an upper portion extending above said lifting arm and a lower portion extending below said lifting arm and into the ground, clamping means engaging said upper portion of said piling means, ram means connected between said clamping means and said lifting arm assembly, and means for actuating said ram means to drive said piling means into the ground until said piling means encounters a predetermined resistance, a plate slidably mounted relative to said rod and connected to said piling means for movement therewith, said actuating means adapted to further actuate said ram means after said predetermined resistance is encountered to raise said lifting arm, said foundation or slab and said rod a predetermined distance relative to said piling means and said plate, and means for securing said rod in said raised position relative to said plate to secure said foundation in its raised position.

2. The apparatus of claim 1 further comprises a support sleeve having a lower portion extending into the ground and an upper portion extending adjacent said lifting arm, said piling means extending through said support sleeve.

3. The apparatus of claim 1 wherein said lifting arm assembly comprises an arm member, a first channel member secured to said arm member, and a second channel member secured to said first channel member to form an opening for receiving said support sleeve.

4. The apparatus of claim 1 wherein said ram means is normally in an expanded position, and wherein said actuating means retracts said ram means to drive said piling means.

5. The apparatus of claim 1 wherein said ram means comprises two ram assemblies extending on opposite sides of said piling means.

6. The apparatus of claim 5 further comprises two mounting plates extending on opposite side of said lifting arm assembly for respectively receiving said ram assemblies.

7. The apparatus of claim 5 wherein said clamping means comprises a clamping member extending around said the upper portion of said piling means, and two mounting plates extending on opposite sides of said clamping member for respectively receiving said ram assemblies.

8. The apparatus of claim 7 wherein said clamping member is adapted to clamp said piling means upon downward movement relative thereto and to disengage said piling means upon upward movement relative thereto.

9. The apparatus of claim 1 wherein there are two rods extending to each side of said piling means, and wherein said securing means comprises a pair of nuts in threaded engagement with said rods.

10. The apparatus of claim 1 wherein said piling means comprises a plurality of pipe segments and wherein said plate extends between two adjacent segments.

11. A method for raising and supporting the foundation or slab of a building, said method comprising the steps of engaging the lower surface of said foundation or slab with a lifting arm assembly including at least one rod, disposing a piling assembly adjacent said lifting arm assembly, engaging piling assembly with a hydraulic ram system, actuating said ram system to drive said piling assembly into the ground until predetermined resistance is encountered, placing a drive plate in operative engagement with said piling assembly and slidably mounting said drive plate over said rod, and then actuating said ram system to raise said lifting arm, said foundation or slab, and said rod a predetermined distance relative to said piling means and said drive plate, and then securing said rod in said raised position relative to said plate to secure said foundation in its raised position.

12. The method of claim 11 further comprising the step of driving the lower portion of a support sleeve into the ground with the upper portion thereof extending adjacent said lifting arm assembly and inserting said piling assembly through said support sleeve.

13. The method of claim 11 wherein said ram system is normally in an expanded position and wherein said step of actuating retracts said ram system.

14. The method of claim 11 wherein said ram system is sequentially expanded and retracted to drive said piling assembly into the ground.

15. The method of claim 11 wherein there are two threaded rods extending to each side of said piling means and wherein said step of securing comprises the step of advancing two nuts over said rods, respectively, a distance corresponding to the distance of said lift.

* * * * *